United States Patent [19]

Fainzilberg

[11] 4,426,081

[45] Jan. 17, 1984

[54] DROP TARGET APPARATUS

[75] Inventor: Zeilik Fainzilberg, Lincolnwood, Ill.

[73] Assignee: Wico Corporation, Niles, Ill.

[21] Appl. No.: 411,500

[22] Filed: Aug. 25, 1982

[51] Int. Cl.[3] ..... A63F 7/00

[52] U.S. Cl. ..... 273/127 D; 273/118 D; 273/123 A

[58] Field of Search ..... 273/121 A, 127 R, 127 C, 273/127 D, 129 A, 129 G, 85 A, 85 E, 129 R, 129 V, 123 A; 200/61.11

[56] References Cited

U.S. PATENT DOCUMENTS

| | | | |
|---|---|---|---|
| 3,975,019 | 8/1976 | Barlow et al. | 273/121 A |
| 4,190,252 | 2/1980 | Kindig | 273/127 R |
| 4,221,384 | 9/1980 | Krynski et al. | 273/121 A |
| 4,257,604 | 3/1981 | Grabel et al. | 273/127 R |
| 4,260,156 | 4/1981 | Momura et al. | 273/127 R |
| 4,311,311 | 12/1982 | Crosman | 200/61.11 |

*Primary Examiner*—Richard C. Pinkham
*Assistant Examiner*—T. Brown
*Attorney, Agent, or Firm*—Dithmar, Stotland, Stratman & Levy

[57] ABSTRACT

The drop target apparatus includes a frame for attachment to the underside of the playfield board of a pinball game. A frame carries a target member which is vertically movable between a raised position above the playfield board and a retracted position. Bias means urges the target member to its retracted position. Latch means hold the target member in its raised position despite the action of the bias means. A recess in the target member receives the pinball. An abutment at the back of the recess when struck by the pinball causes the target member to become unlatched and moved, along with the pinball carried thereby, to its retracted position.

10 Claims, 5 Drawing Figures

DROP TARGET APPARATUS

THE BACKGROUND OF THE INVENTION

In the typical drop target apparatus of a pinball game, a target member is vertically movable through a slot in the frame between a raised position extending above the playfield board of the pinball game and a retracted position. The target member is coupled to a bias means which urges it toward its retracted position and which also urges it, when it is in its raised position, toward a latched condition to hold the target member in its raised position and prevent it from dropping to its retracted position. When the raised target member is struck by a pinball, it is deflected backwards a sufficient distance to unlatch it from the frame, whereupon it is retracted by the bias means. Such a device is disclosed in application Ser. No. 289,371 assigned to the assignee of this application. After striking such target member, the ball continues to roll on the playfield board striking other targets or striking the flippers which when actuated propel the ball back toward the top of the playfield board to strike additional targets.

SUMMARY OF THE INVENTION

It is an important object of the present invention to provide a drop target apparatus which instead of deflecting the ball is engulfed by the target and retracted.

In summary, there is provided in a pinball game having a playfield board, a pinball that rolls on the board, and a drop target apparatus adapted to be struck by the rolling pinball and comprising a frame, a target member vertically movable with respect to the frame between a raised position projecting above the playfield board and a retracted position, the target member and the frame having interengaging latch means shiftable between a latched condition preventing vertical movement and a released position permitting vertical movement, and bias means urging the target member to its retracted position and simulataneously urging the latch means to the latched condition thereof, the target member including means defining a recess therein for receiving the pinball, the recess having an abutment for impingement by the pinball upon entering the recess to unlatch the latch means, whereupon the bias means draws the target member and the pinball carried thereby into the retracted position.

The invention consists of certain novel features and a combination of parts and steps hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Referring now more particularly to the drawings, there is illustrated a drop target apparatus, generally designated by the numeral 10, constructed in accordance with and embodying the features of the present invention.

Figure 3:
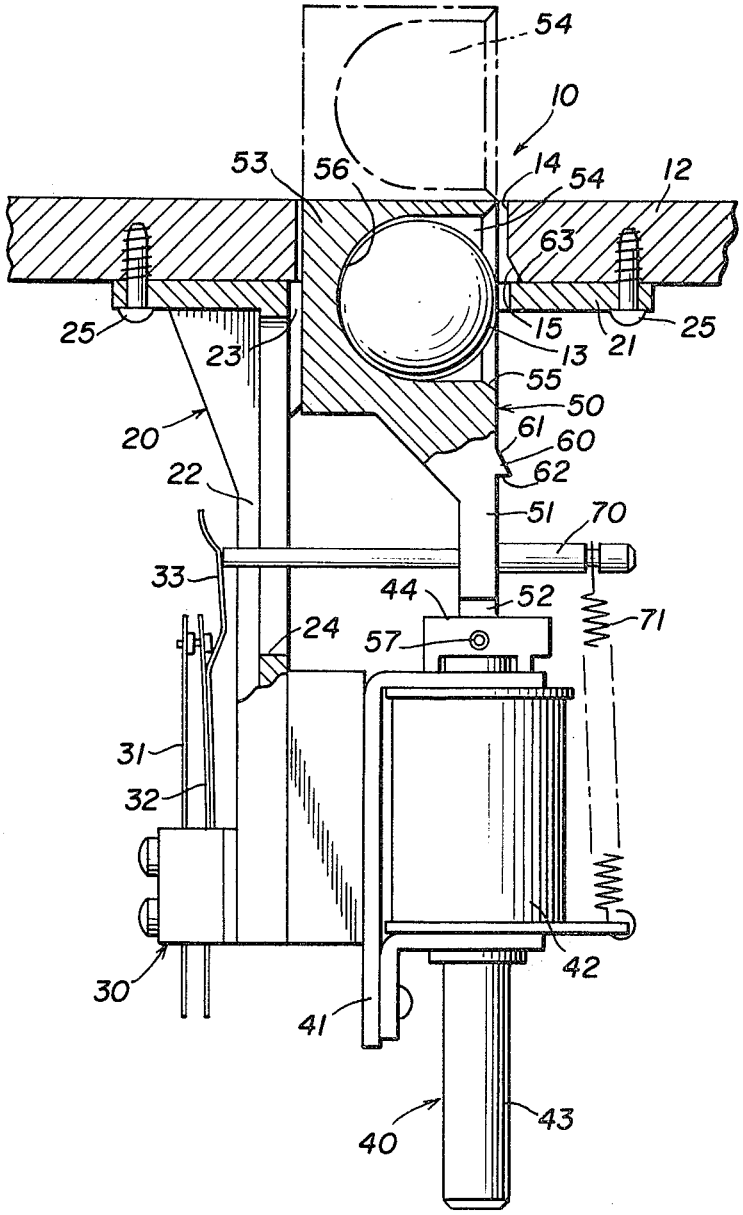
FIG. 3 is a view like FIG. 2 but with the target member shown in its retracted position in solid line and shown in phantom to indicate its raised position.
Figure 5:
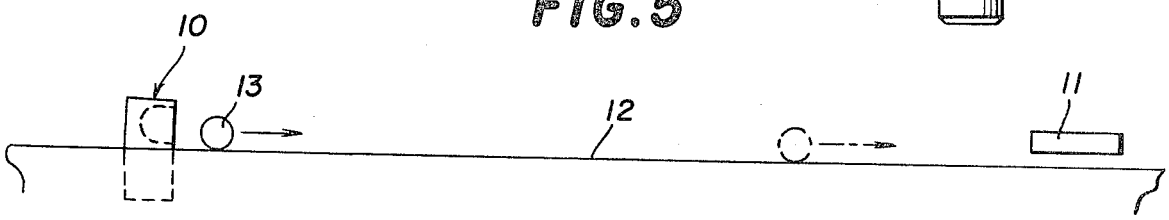
FIG. 5 is a schematic view of the pinball game and the drop target apparatus.

Referring to FIG. 5, the drop target apparatus 10 is for use in a pinball game having a shooter 11 for delivering onto a playfield board 12 pinballs 13. Usually the playfield board 12 is inclined slightly toward the shooter 11 so that the pinball 13 after striking a target will roll back toward the region of the shooter 11 where there is also located flippers (not shown) and a chute (not shown) for collecting the pinballs. The drop target apparatus 10 is mounted beneath the playfield board 12, being aligned with a substantially square opening 14 therein. The lower front edge of the opening 14 is beveled at 15 (FIG. 3).

The drop target apparatus 10 comprises a frame generally designated by the numeral 20, which may be formed of plastic and be of one-piece construction, the frame 20 including an upstanding post 22 which carries at the upper end thereof an attachment flange 21 extending substantially normal thereof. The attachment flange 21 has a flat upper surface which is disposed against the lower surface of the playfield board 12 and is fixedly secured thereto by screws 25. The attachment flange 21 has a rectangular target opening 23 therein. The post 22 has an elongated, vertically arranged actuator slot 24 extending from the attachment flange 21 down more than halfway in the embodiment depicted. The target opening 23 is in registry with the opening 14 in the playfield board 12. Mounted on the rear surface of the post 22 is a switch mechanism 30 which includes a fixed contact 31, a movable contact 32 and a actuator 33 abutting against the movable contact 32 and having a portion extending upwardly therefrom. The actuator 33 is deflectable in a manner to be described below, for moving the movable contact 32 into engagement with the fixed contact 31.

Mounted on the front surface of the post 22 is a reset mechanism 40 which includes a mounting bracket 41. A solenoid coil 42 is carried by the mounting bracket 41 and has an elongated solenoid plunger 43 extending vertically coaxially therethrough. When energized, the solenoid coil 42 will move the plunger 43 upwardly. The plunger carries a collar 44.

The drop target apparatus 10 further comprises a target member 50 which is preferably molded of one-piece plastic. The target member 50 includes a rectangular body 51, a coupling tongue 52 depending from one end of the body 51 and a block-shaped head 53 protruding from the other end of the body. The head 53 has a generally cylindrical recess 54 therein arranged with its axis generally horizontal and having a diameter greater than the diameter of the pinball 13. The mouth 55 of the recess 54 is beveled slightly to guide the pinball 13 therein. The recess 54 terminates at its rear in an abutment 56 which, in the depicted embodiment, is part spherical. The coupling tongue 52 is disposed in the collar 44 of the reset mechanism 40 and is pivotally attached thereto by means of a pin 57.

Figure 4:
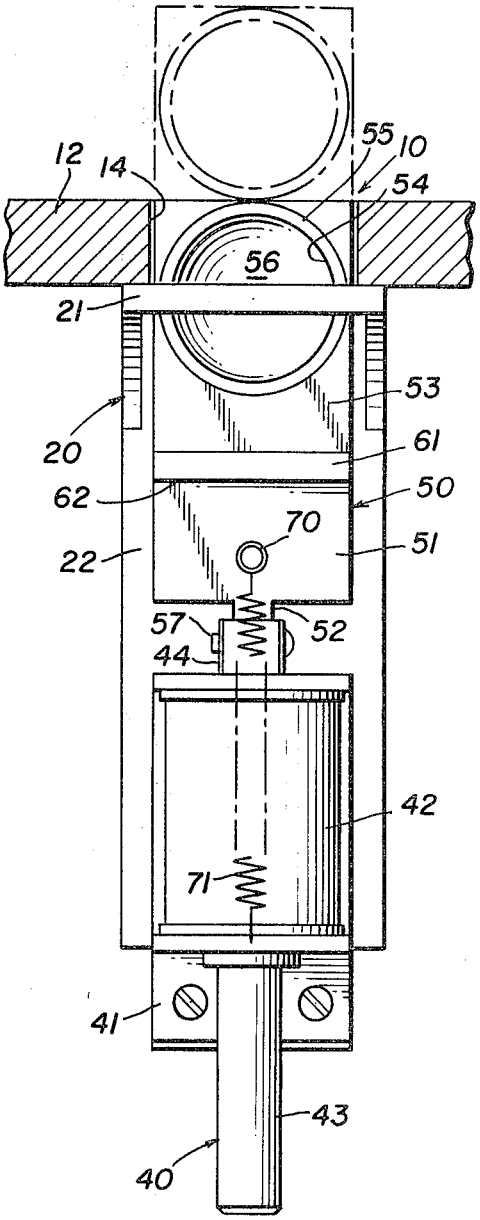
FIG. 4 is a front elevational view of the target apparatus depicted in FIG. 3 but with the pinball omitted.

The target member 50 is oriented so as to extend upwardly vertically through the target opening 23 in the attachment flange 21 and through the opening 14 in the playfield board 12. The target member 50 is vertically movable through the openings 14 and 23 between a raised or fully extended position illustrated in solid line in FIG. 2 and in phantom line in FIGS. 3 and 4, and a retracted or fully lowered position illustrated in solid line in FIGS. 3 and 4.

In order to hold the target member 50 in its raised position, there is provided a latch mechanism which includes a tongue 60 on the target member 50 and a shoulder 63 on the frame 20. Specifically, the tongue 60 extends horizontally across the front face of the rectangular body 51 and has an upwardly and rearwardly inclined camming surface 61 and a downwardly facing horizontally oriented locking abutment 62. The shoulder 63 is on the attachment flange 21, specifically that portion adjacent to the front of the opening 23 in the region of the bevel 15. In the latched condition depicted in FIG. 2, the tongue 60 is located in the bevel 15 with the abutment 62 bearing against the shoulder 63, thereby precluding downward movement of the target member 50.

A pin 70 extends horizontally through the body 51 of the target member 50 and is secured thereto, one end being disposed within the slot 24. A helical tension spring 71 extends between the other end of the pin 70 and the mounting bracket 14. The spring 71 provides a bias which urges the target member 50 toward its retracted position. Furthermore, when it is in its raised position, the target member 50 is pivotally movable about the axis of the pin 57 between the latched condition depicted in FIG. 2 and the released condition illustrated in FIG. 3. In its released condition, the target member 50 is pivoted rearwardly so that the abutment 62 clears the shoulder 63, thereby to permit the target member 50 to be retracted under the urging of the spring 71. The rear portion of the pin 70 being in the slot 24 is guided thereby in its vertical movement. The spring 71 exerts not only a downward bias on the target member 50, but also a forward bias so as to resiliently urge the target member 50 toward its latched condition. Thus, whenever the target member 50 is moved to its raised position, it will automatically latch under the urging of the spring 71.

Figure 1:
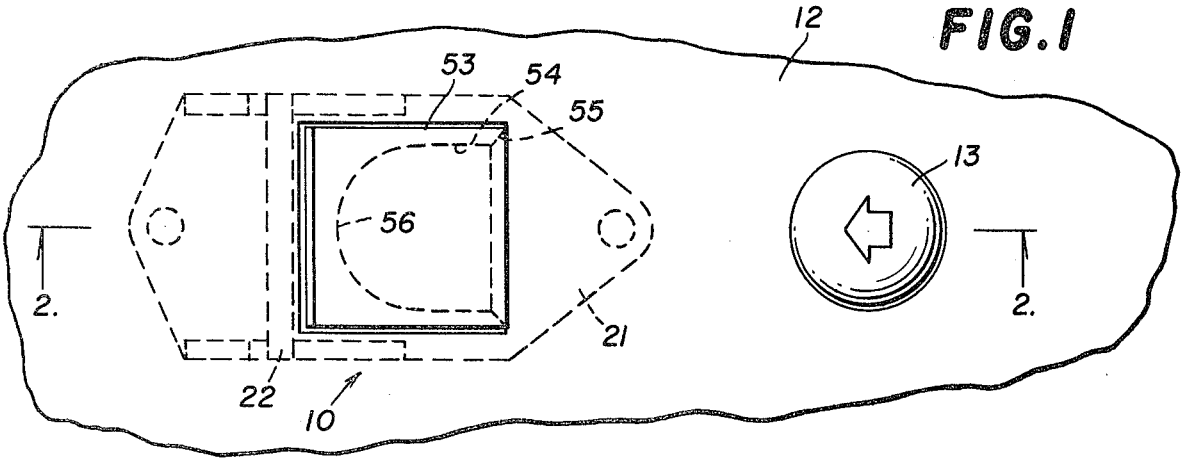
FIG. 1 is a fragmentary plan view of a playfield board, a rolling pinball thereon and a drop target apparatus incorporating the features of the present invention.
Figure 2:
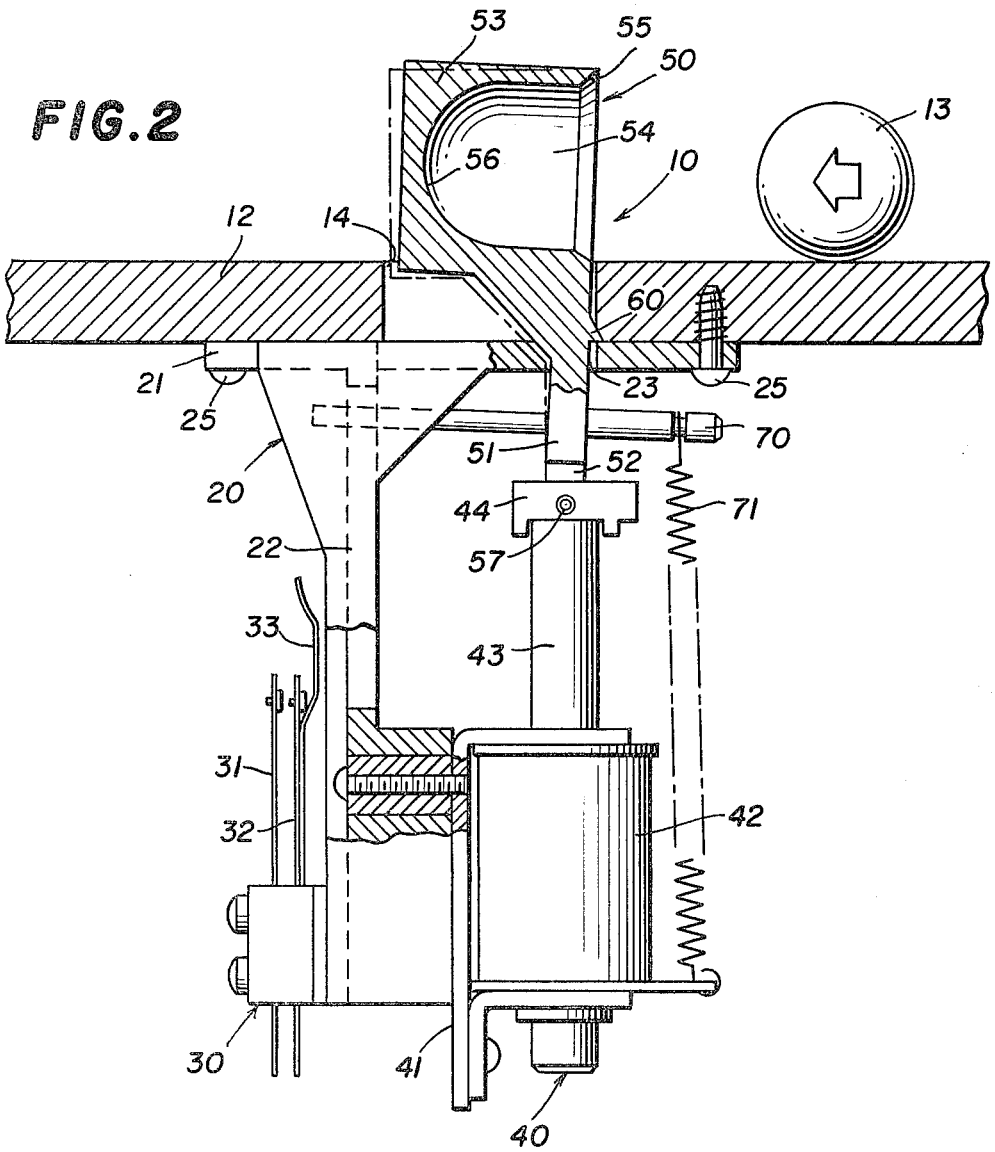
FIG. 2 is a view in vertical section taken along the line 2—2 of FIG. 1, the solid outline of the target head indicating the latch condition thereof and the phantom outline of such target being the unlatch condition thereof.

When the target member 50 is in its raised position, the recess 54 is above the upper surface of the playfield board 12, as illustrated for example in FIG. 2. When the pinball 13 is directed toward the drop target apparatus 10, the ball 13 enters the recess 54 being guided therein by the flared mouth 55, to strike the rear abutment 56, causing the target member 50 to tilt rearwardly from its latched condition to its released condition as illustrated in FIG. 3. The head 53 is pulled downwardly under the force of the spring 71 thereby to "consume" the ball and hide it from the player. When the target member 50 is in its raised position, the switch contacts 31 and 32 are open, as illustrated in FIG. 2, so that the solenoid coil 42 is deenergized. When the target member 50 is moves to its retracted position, the pin 70 engages the actuator 33 for closing the contacts of the switch mechanism 30. Power for the solenoid coil 42 may be applied through the contacts 31 and 32 so that as soon as the target member 50 is retracted, the solenoid coil 42 is energized causing the plunger 43 to move upwardly for resetting the target member 50 to its raised position. The playfield board may be inclined, so that the pinball 13 rolls out of the recess 54 in the direction of the shooter 11 (FIG. 5). Alternatively, the contacts 31 and 32 can be coupled through delay circuitry so that the pinball is hidden for a set period of time. Alternatively, additional structure may be provided to receive the ball after the target member 50 is retracted. Such structure could route the pinball to other stations, targets, etc. Instead of the playfield board 12 being inclined, the abutment 56 could have a hole to receive an ejector pin to eject the ball from the recess 54 after the target member 50 has been moved to its raised position.

From the foregoing, it can be seen that there has been provided an approved drop target apparatus for a pinball game which withdraws the pinball to a hidden position beneath the playfield board.

I claim:

1. In a pinball game having a playfield board, a pinball that rolls on the board, and a drop target apparatus adapted to be struck by the rolling pinball and comprising a frame, a target member vertically movable with respect to said frame between a raised position projecting above the playfield board and a retracted position, said target member and said frame having interengaging latch means shiftable between a latched condition preventing vertical movement and a released position permitting vertical movement, and bias means urging said target member to its retracted position and simultaneously urging said latch means to the latched condition thereof, said target member including means defining a recess therein for receiving the pinball, said recess having an abutment for impingement by the pinball upon entering said recess to unlatch said latch means, whereupon said bias means draws said target member and the pinball carried thereby into the retracted position.

2. The drop target apparatus of claim 1, wherein the depth of said recess is substantially equal to the diameter of the pinball.

3. The drop target apparatus of claim 1, wherein said target member includes a block-shaped head and an arm carrying said block, said recess forming means being in said head.

4. The drop target apparatus of claim 1, wherein said recess is generally cylindrical and said abutment is part spherical.

5. The drop target apparatus of claim 1, wherein said recess has a flared mouth to guide the ball into said recess.

6. The drop target apparatus of claim 1, and further comprising switch means having open and closed conditions, said switch means being in one condition thereof when said target member is in the raised position thereof and being moved to the other condition thereof as the target member is moved to the retracted position thereof.

7. In a pinball game having a playfield board, a pinball that rolls on the board, and a drop target apparatus adapted to be struck by the rolling pinball and comprising a frame, a target member vertically movable with respect to said frame between a raised position projecting above the playfield board and a retracted position, said target member and said frame having interengaging latch means shiftable between a latched condition preventing vertical movement and a released position permitting vertical movement, bias means urging said target member to its retracted position and simultaneously urging said latch means to the latched condition thereof, said target member including means defining a recess therein for receiving the pinball, said recess having an abutment for impingement by the pinball upon entering said recess to unlatch said latch means, whereupon said bias means draws said target member and the pinball carried thereby into the retracted position, and a reset mechanism for automatically returning said target member to the raised position thereof, whereupon said latch means is automatically returned to the latched condition thereof.

8. The drop target apparatus of claim 7, wherein said reset mechanism includes a solenoid having a plunger coupled to said target member.

9. The drop target apparatus of claim 7, wherein said target member is pivotally mounted on said plunger.

10. The drop target apparatus of claim 9, wherein said latch means includes a tongue on said target and a shoulder on said frame, said tongue having a camming surface and an abutment, said abutment being in engagement with said plunger in the latched condition, said camming surface engaging said shoulder as said target member is being moved to the raised position thereof and until said camming surface clears said shoulder, whereupon said abutment is caused to engage said shoulder by action of said bias means.

* * * * *